United States Patent [19]

Dalebout et al.

[11] Patent Number: 5,016,871

[45] Date of Patent: May 21, 1991

[54] EXERCISE MACHINE RESISTANCE CONTROLLER

[75] Inventors: William T. Dalebout; Curt G. Bingham, both of Logan, Utah

[73] Assignee: Proform Fitness Products, Inc., Logan, Utah

[21] Appl. No.: 428,214

[22] Filed: Nov. 1, 1989

[51] Int. Cl.[5] ..... A63B 23/04

[52] U.S. Cl. ..... 272/73; 272/DIG. 6

[58] Field of Search ..... 272/73, DIG. 5, DIG. 6, 272/129, 69, 70

[56] References Cited

U.S. PATENT DOCUMENTS 4,519,603 5/1985 DeCloux ..... 272/73

4,630,818 12/1986 Saarinen ..... 272/73

*Primary Examiner*—Stephen R. Crow

*Attorney, Agent, or Firm*—Trask, Britt & Rossa

[57] ABSTRACT

The speed of operating structure of an exercise machine is sensed and rotates a worm gear interconnected to a reduction gear assembly to rotate a driver at a preselected rate. The driver is interconnected to drive a cam surface upon which a cam follower rides to in turn operate a pivoted lever. The lever is interconnected to transmit the movement of the cam follower to operate the resistance means of the exercise machine to increase or decrease the resistance being applied to the operating structure of the exercise machine.

32 Claims, 10 Drawing Sheets

62
31
33
30
60
34
35
90
10
29
28
36
26
32
54
242
27
78
76
52
228
50
12
82
86
77
16
38
74
18
14
20
66
84
72
44
23
80
24
56
25
22
42
70
66
40
68

242
228
284
288
286
287
77
242

66
146
206
146
256
200
132
258
260
270
266
268
268
262
44
252
254
264
250
76
280

EXERCISE MACHINE RESISTANCE CONTROLLER

BACKGROUND OF THE INVENTION

1. Field

This application relates to control devices for exercise machines which have a variable resistance to resist movement of interconnected operable structure including specifically stationary exercise cycles.

2. State of the Art

Exercise machines such as stationary exercise cycles are well known. Typical stationary exercise cycles have variable resistance for resisting movement of operable structure. More specifically, a brake or similar friction device is positioned to resist movement of a rotatable wheel which is rotated by a pedaling movement by the user. The user may vary the friction applied against the wheel and in turn the resistance to the performance of the exercise. The friction may be varied in several different ways including operation of mechanical structure to tighten or loosen the braking structure associated with the wheel.

Other exercise machines are known which similarly operate. For example, a flywheel-type rowing machine may have a resistance associated with its flywheel in a manner structurally similar to that of a stationary exercise cycle but in a configuration wherein the user resides upon a slidable seat and pulls on a cable or handle to perform a rowing-type exercise. Similarly, a treadmill offers resistance through speed or incline which may be adjusted.

For machines which have a resistance means for variably resisting the movement of interconnected operable structure including, but not limited to, the aforementioned stationary exercise cycles and rowing machines, the user typically must adjust the resistance in order to experience different degrees of resistance. If the user desires to undertake an exercise program in which the resistance varies, the user must periodically readjust the resistance during the program. In such circumstances, the user may not be able to accurately repeat the same program(s) when desired. One stationary exercise cycle is known in which the user may select different levels or degrees of resistance electrically to thereafter vary a resistance imposed by an associated electrical device. However, no simple mechanical or electromechanical structure has been presented in which various selected prescribed programs can be readily made available to any number of users in addition to preselected or predesigned programs for specific users.

SUMMARY OF THE INVENTION

A controller is provided for use with an exercise machine having resistance means for variably resisting the movement of interconnected operable structure. The controller has sensing means positioned to sense the movement of the operable structure and to supply movement signals reflective of the movement. Conversion means is connected to the sensing means to receive the movement signals. The conversion means has a driver and is configured to move the driver in relation to the movement signals. Cam means is positioned proximate the driver for movement thereby. The cam means has a cam surface with variations preselected by the user and reflective of the desired resistance of the resistance means of the exercise machine. Reading means are positioned proximate the cam surface to generate signals reflective of the variations and to supply resistance signals reflective of the variations. Receiving means are connected to the resistance means and to the reading means to receive the resistance signals and thereby operate the resistance means to variably resist movement of the operable structure in accordance with the resistance signals.

The conversion means may move the driver proportional to the movement signals. The conversion means is preferably a reduction gear assembly interconnected to be driven by the movement signals and to operate the driver. The cam means is preferably a substrate having engaging means configured to be driven by the driver and an edge as said cam surface. The driver is desirably a driven gear of the reduction gear and the edge is serrated to mesh or be drivingly associated with the driven gear.

In one embodiment, the cam may be a disk-like structure with a central axis and rotatable thereabout. The cam surface may be the perimeter of the disk-like structure. In another configuration, the engaging means is substantially straight, with the cam surface positioned opposite the engaging means.

The reading means is preferably a cam follower secured to a pivotable lever to pivot as the cam follower moves along the cam surface. The pivotable lever has transmission means connected thereto to transmit the resistance signals upon movement of the pivotable lever. The transmission means is preferably a cable secured to the lever to move axially as the lever pivots. In another configuration, the transmission means is a variable electrical resistance interconnected to a source of power to supply a variable electrical signal as the resistance signal. The receiving means includes an electrical device connected to receive the variable electrical signals and to operate the resistance means.

In other embodiments, the receiving means may be connector or mechanical bracket structure interconnected with the resistance means to operate the resistance means. In one preferred embodiment, the pivotable lever has a handle portion extending outwardly from the controller for operation by the user.

In one alternative arrangement, the sensing means may be a source of power such as a spring to power the conversion means.

In one configuration in which the operable structure rotates, the sensing means is a speedometer pickup which is positioned to sense the rotation. A speedometer cable is connected to the speedometer pickup to transmit the movement signals. The speedometer cable has a worm interconnected at its distal end to drive the reduction gear assembly, which in turn operates the driver to cause the cam surface to move. The cam follower thereupon moves along the cam surface and causes the pivotable lever to pivot and the transmission means to transmit the desired resistance signals to the resistance means. In a preferred configuration, the exercise machine is a stationary exercise cycle. Notably, the exercise cycle has an adjustable handlebar structure.

BRIEF DESCRIPTION OF THE DRAWINGS

In the drawings which illustrate the best mode presently contemplated for carrying out the invention.

DESCRIPTION OF THE ILLUSTRATED EMBODIMENT

Figure 1:
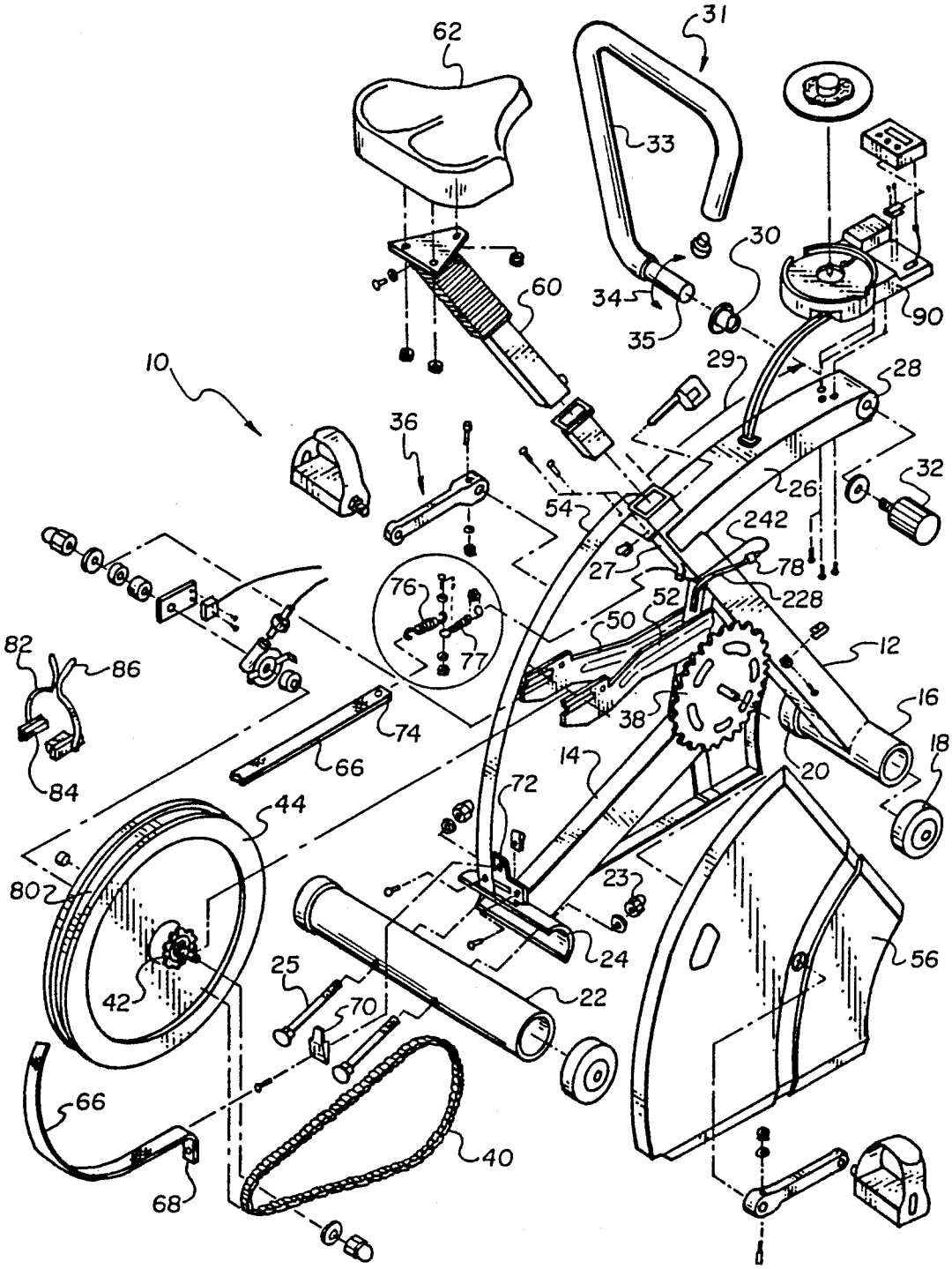
FIG. 1 is an exploded view of an exercise machine and controller of the invention.

Referring to FIG. 1, an exercise machine having resistance means for variably resisting the movement of interconnected operable structure is depicted in exploded format. The particular exercise machine selected is a stationary exercise cycle. Other configurations of exercise machines having resistance means for variably resisting the movement of interconnected operable structure are known and not here illustrated for simplicity of illustration and discussion. However, the principles discussed with respect to the exercise cycle illustrated in FIG. 1 are equally applicable to other similarly configured exercise machines, including treadmills in which the speed of the tread and/or angle of inclination may be varied to vary the resistance.

In FIG. 1, the exercise cycle 10 illustrated has a forward support member 12 and a rear support member 14 to form a frame structure. The forward support member 12 has a foot 16 connected thereto with rollers 18 and 20 adapted thereto so the cycle 10 may be lifted at one end and rolled on the rollers 18 and 20. The rear member 14 also has a foot 22 secured to a bracket structure 24 by illustrated nuts 23 and bolts 25.

The cycle 10 has a nose member 26 extending away from the upper end 27 of the forward support 12 an appropriate distance 29 so that handlebar structure 31 may be conveniently positioned for the user. The handlebar structure 31 is inserted into an appropriate aperture 28. A bushing 30 holds the handlebar structure 31 firmly but rotatably in the aperture 28. A manually operable knob 32 secures the handlebar structure 31 to the nose member 26 as illustrated. The handlebar structure 31 and specifically the handle portion 33 may be adjusted and, more particularly, rotated 34 to a comfortable position as desired by the user positioned on the seat 62 by operating the knob 32. That is, the knob 32 may be loosened so the handle portion 33 is positionable or rotatable 34 as desired. The knob 32 is then tightened to hold the handlebar structure 31 firmly in place by a threaded connection to the distal end 35 of the handlebar structure 31.

The exercise cycle 10 of FIG. 1 has appropriate pedal and crank structure 36 interconnected to drive a sprocket 38 which in turn drives a chain 40. The chain is drivingly interconnected to a driven sprocket 42 which is connected to rotate a flywheel 44. The flywheel 44 is positioned on support brackets 50 and 52 within a housing having a left half 54 and a right half 56.

The exercise cycle 10 of FIG. 1 also has an adjustable seat post 60 with an appropriate seat 62 secured thereto for further connection to the forward member 12.

The flywheel 44 has resistance means associated therewith which is here illustrated as a strap 66 secured at one end 68 by an appropriate bracket 70 to a frame bracket 72. The other end 74 of the strap 66 is connected by a spring structure 76 and associated connecting clamps and nuts and bolts 77 to a cable 242 extending from connector 78. The cable 242 is operable to vary the resistance of the resistance means of the machine which is the strap 66. That is, the resistance may be varied by tightening or loosening the strap 66 as hereinafter discussed.

It may be noted that the flywheel 44 has a groove 80 formed therein to accommodate the strap 66. In operation, the strap 66 is tensioned either more tightly or loosened in order to resist movement of the flywheel 44. Alternately, a caliper structure 82 may be positioned with brake surfaces 84 positioned for contact with the outer portions of the flywheel 44. A cable 86 may be directly connected to the connector 78 for operation of the calipers 82 in a conventional fashion. That is, a conventional caliper brake as presently used on a wide number of bicycles and exercise cycles may be adapted as the resistance means for an exercise cycle of the type here illustrated.

In FIG. 1, portions of the controller of the invention are illustrated. More particularly, the conversion means which is positioned within a chassis 90 is shown for connection to the nose member 26 of the exercise cycle 10 of FIG. 1.

Figure 2:
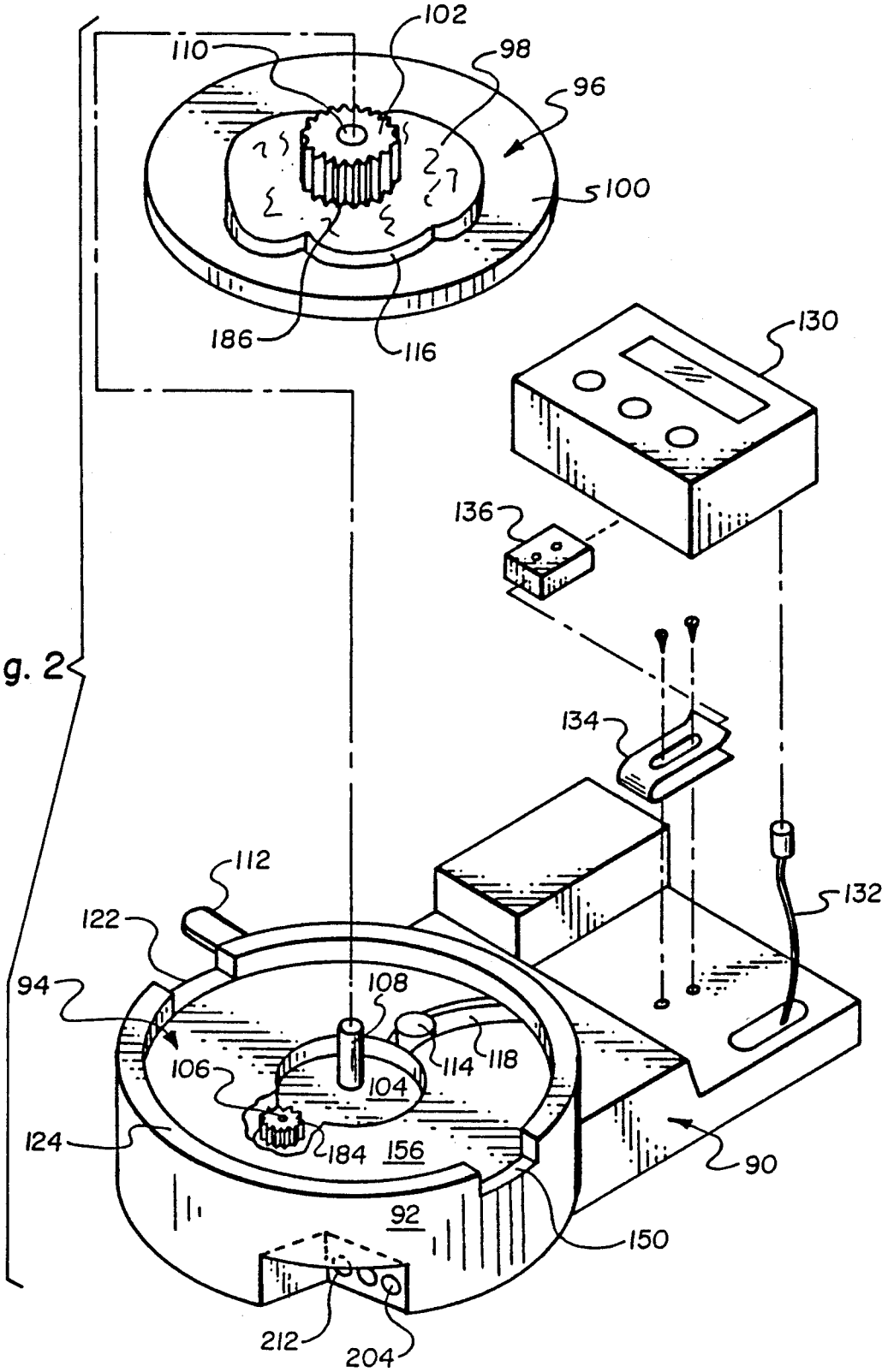
FIG. 2 is a perspective exploded view of one embodiment of the cam and conversion structure of the controller of the instant invention.

Referring to FIG. 2, the chassis 90 is shown in greater detail. Specifically, the chassis 90 has a housing 92 which is here shown to be cylindrical in configuration. The conversion means is positioned within the housing 92 as discussed hereinafter. The housing 92 has a recess 94 sized to receive cam means which is here shown as a disk-like structure 96 having a cam 98 and engaging means which is here shown as gear 102. In FIG. 2, the disk-like structure 96 is shown upside down for clarity of illustration. The gear 102 is positioned into the recess 104 for a meshing or driving engagement with a driver 106. The disk-like structure 96 is rotatably and registrably positioned in the recess 94 by insertion over the shaft 108 through the aperture 110. As the disk-like structure 96 is being inserted into the recess 94 with the gear 102 into the recess 104, the handle 112 is operated in order to move the cam follower 114 so that it rides upon the cam surface 116 of the disk-like structure 96 and in turn the cam follower 114 moves in its slot 118 to operate the reading means as more fully discussed hereinafter.

Figure 3:
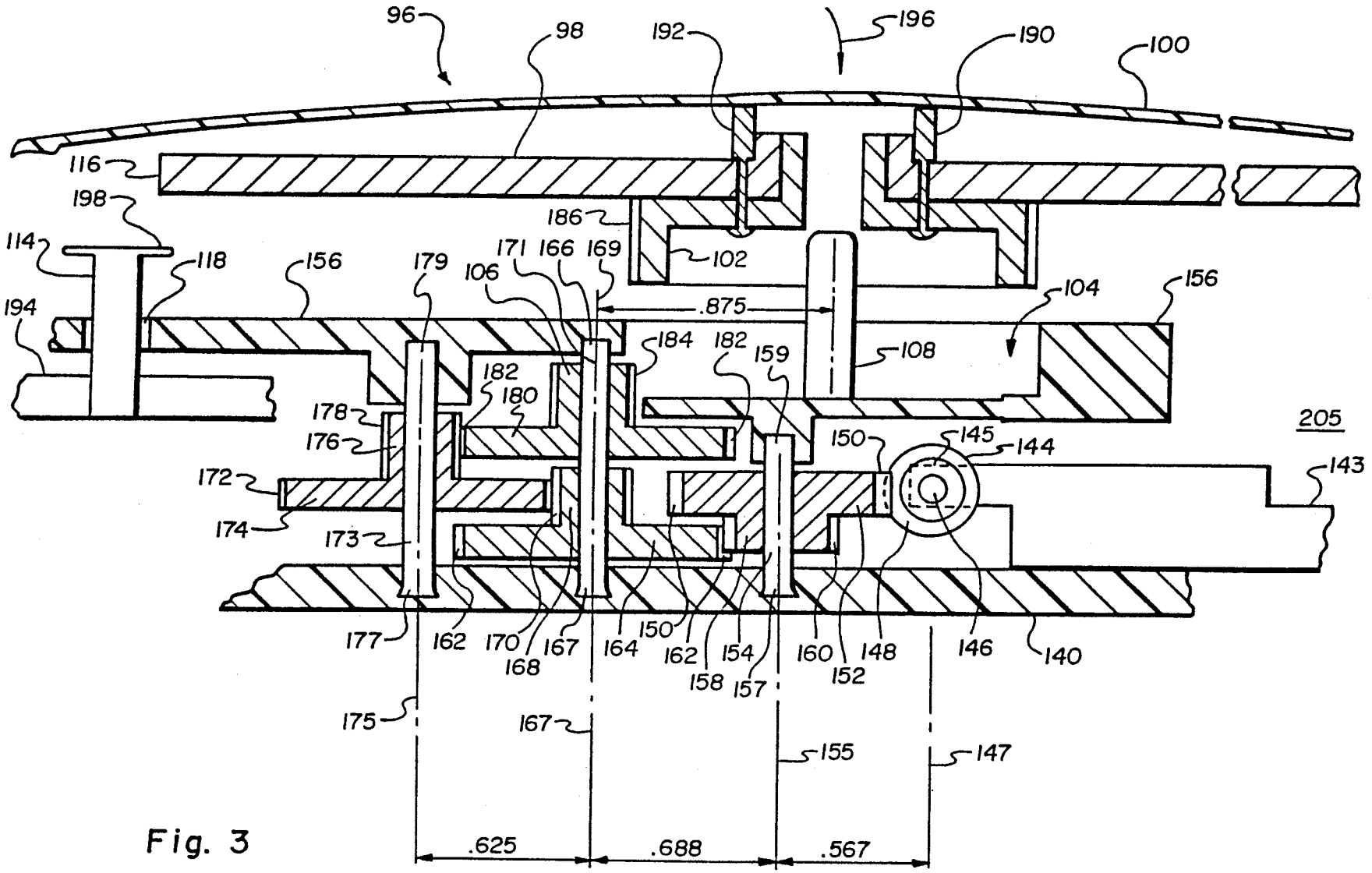
FIG. 3 is a partial cross-sectional view of the conversion means of the controller of the instant invention.

A cover or dome 100 is secured to the disk-like structure 96 by pins 192 and 190 (FIG. 3). However, at present it is preferred to secure the dome 100 in the disk-like structure 96 using an ultrasonic bonding process. It may be noted that a first port 120 and a second port 122 are formed in the sidewall 124 of the housing 92 to facilitate insertion and removal of the disk-like structure 96 by manipulation of the dome 100.

Also shown in FIG. 2 is an electronic console 130 which is connected to receive an electrical signal via an electrical conductor 132 from a sensor. The electrical signal received allows the electronic device 130 to display the speed or RPM (revolutions per minute) of the flywheel 44. The electronic console 130 is removably held to the chassis 90 by a clip structure 134 secured the chassis 90 and a clip arrangement 136 secured to the electronic unit 130. The electronic console 130 may include other functions and features as desired.

Figures 4, 4A:
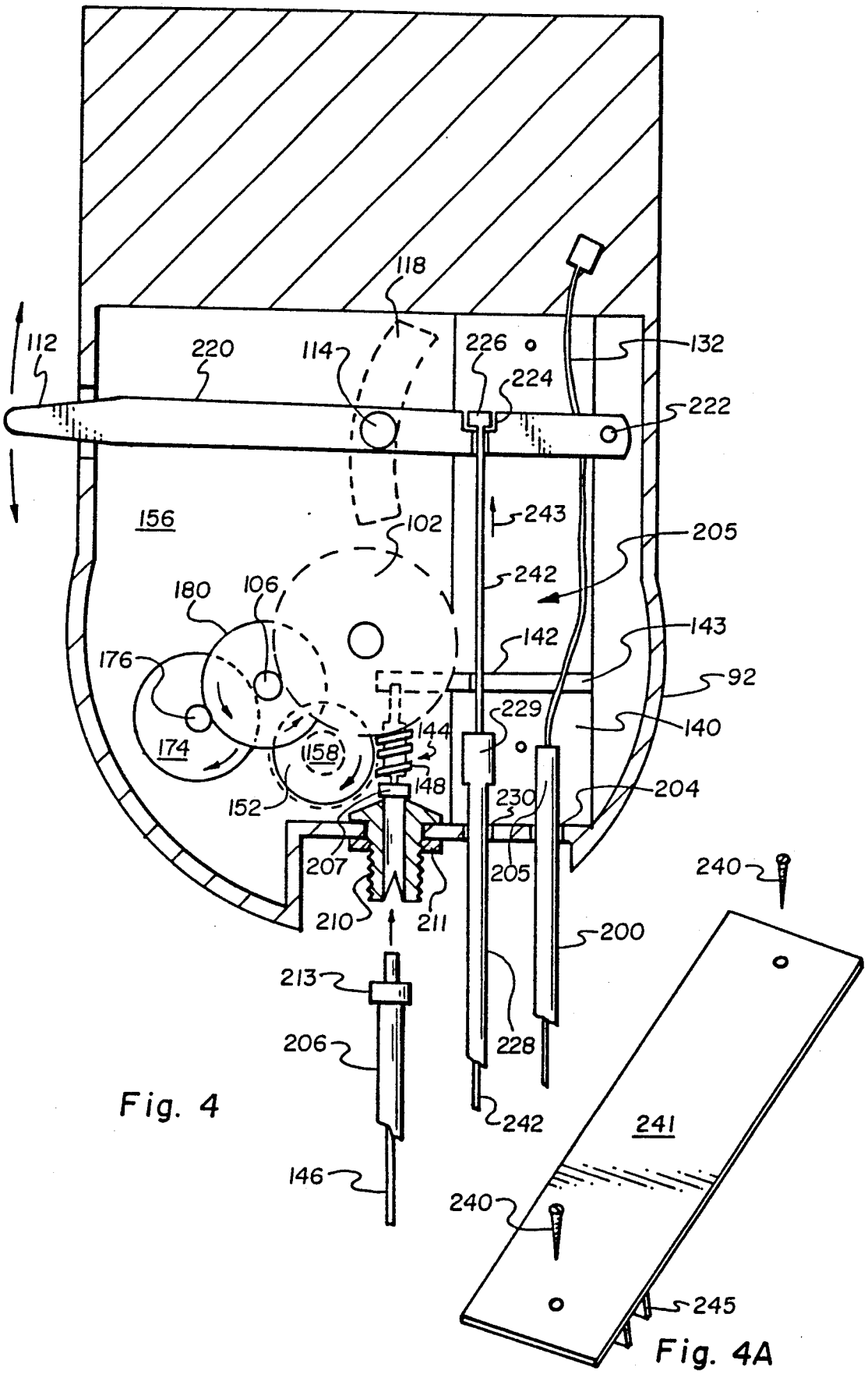
FIG. 4 is a top cross-sectional representation of the conversion structure shown in FIG. 2.

Referring now to FIG. 3, the conversion means is here illustrated partially in cross-section. More particularly, the housing 92 is formed with a base 140. The base has an abutment 142 extending upwardly therefrom to receive and support a worm 144. As here shown, the worm 144 has a central driving shaft 146 which is connected into the abutment 142 (FIG. 4).

The worm 144 has a body 145 with conventional driving surfaces or teeth 148 which are interconnected to the teeth 150 of worm gear 152 which is a helical gear. The worm gear 152 is rotatably mounted to the shaft 154 which is secured between the base 140 and the top 156 of the housing 92. The worm gear 152 thereby rotates upon rotation of the worm 144 to in turn drive the pinion 158. The pinion 158 has teeth 160 which are drivingly interconnected to the teeth 162 of a second spur gear 164 rotatably secured to shaft 166 which is mounted between the base 140 and the top 156. The second spur gear 164 drives the pinion 168 which is drivingly interconnected at its teeth 170 with the teeth 172 of a third spur gear 174. The third spur gear 174 rotates on shaft 173 and drives another pinion 176 which is drivingly interconnected by its teeth 178 to a fourth spur gear 180 at its teeth 182. The spur gear 180 rotates on shaft 166 and drives the pinion 106 which is also illustrated in FIG. 2. Pinion 106 has teeth 184 which mesh with a gear 102 of the disk-like structure 96 by its teeth 186. A spindle 108 as shown in FIG. 2 as well as in FIG. 3 is secured to the top 156 within the aperture 104 in order to centrally register the disk-like structure 96 and more particularly the gear 102 so that it will drivingly mesh with the pinion 106.

It can be seen that the worm gear 152 and the spur gears 164, 174 and 180 together constitute a reduction gear assembly separately as well as in combination with the gear 102. The worm 144 is interconnected to the worm gear 152 in a forty-to-one relationship. The first pinion 158 is an 18-tooth pinion. Spur gears 164, 174 and 180 are each 48-tooth gears with 12-tooth pinions 168, 176 and 106. Driven gear 102 is preferably a 72-tooth spur gear. The combination of gears used results in a proportional drive system having a total gear ratio of 10250:1 with the spacing between the axis 147 of the shaft 146 and the axes 155, 167 and 175 of the various gear shafts 154, 166, 173 and the post 108 as shown in FIG. 3. The total gear ratio can be changed by changing the gears and in turn vary the speed and in turn the time of rotation of the disk-like structure 96. Although a specific reduction gear assembly is here shown and described above, it should be understood that other forms and types of gear assemblies may be used to drive the disk-like structure 96 or other cam means.

The shafts 154, 166 and 173 are all preferably made of a powdered metal. However, any convenient durable metal may also be used if desired. The lower ends 157, 167 and 177 of the shafts 154, 166 and 173 respectively are each flared. They are pre-positioned in the plastic base 140 by molding them in place. The upper ends 159, 171 and 179 are each snugly fitting into apertures formed in the top 156. Thus, the shafts 154, 166 and 173 are securely held in place. A lubricant may be placed on the shafts 154, 166 and 173 before the various gears are placed thereon to facilitate rotation thereof.

Also illustrated in FIG. 3 is the pivotable arm 194 and the cam follower or post 114 attached thereto. The cam follower 114 operates in the slot 118. In operation, the disk-like structure 96 would be positioned downwardly 196 so that the gear 102 inserts into the cavity 104 and meshes with gear 106. Operation of the handle 112 moves the cam follower 114 out of the way so that the cam disk 98 itself can be positioned properly under the lip 198 of the cam follower 114.

Referring now to FIG. 4, a top cross-sectional view of the conversion means in the housing 92 is shown. It may be noted that the connector 132 (FIG. 2) is part of sheathed cable 200. The sheath passes through an aperture 204 into cavity 205.

In FIG. 4, a movement signal is received by a sheathed cable 206 which has a rotatable member which is the rotatable shaft 146 of the worm 144 to in turn drive the worm gear 152. Various spur gears and pinions are shown without detailing their teeth for purposes of clarity. As can be seen, the worm 144 is held in place by a zinc housing 210 in an aperture 212 (FIG. 2) formed in the housing sidewall 124. The 72-tooth spur gear 102 is shown in phantom to illustrate the general orientation and configuration of the various gears.

The cam follower 114 is shown in FIG. 4 attached to a pivotable lever arm 220 which pivots about shaft 222. The cam follower 114 moves within the slot 118 (here shown in dotted line) in the top 156 as it rides upon the cam surface of the various cams such as cam surface 116 hereinbefore illustrated. The cam follower 114 is tensioned against the cam surface such as cam surface 116 by the cable 243. The pivotable lever 220 also has a handle 112 to facilitate installation of the cams as hereinbefore stated.

As can be seen, the pivot arm 220 has a slot 224 formed therein to receive the end 226 of a transmission device which is here shown to be a sheathed cable 228. More particularly, the sheath is secured in aperture 230 by a screws 240 which hold the cover 241 in the cavity 205 and in turn clamp or pinch the ends 205 and 229 by fingers 245 against the base 140. In securing the sheath of the cable 228, the internal cable 242 may move therewithin, to translate the pivoting movement of the pivotable arm 220 to axial movement at the opposite end of cable 228 and more particularly at connector 78 (FIG. 1) where the cable 242 exits the sheath.

The zinc housing 210 snugly receives the sheathed cable 206. The brass worm 144 is inserted onto the shaft 146 to rotate against the washer 207. The zinc housing 210 is held in place by a threaded nut 211. The housing 210 may be a conventional speedometer cable receptacle to which the cable 206 is connected by nut 213.

It may also be noted that the cavity 205 is formed so the conductor 132 may pass through the housing 132 for connection to the console 130. A recess 143 may be formed in the member 142 to facilitate passage of cable 242 and conductor 132.

Figures 5, 5A:
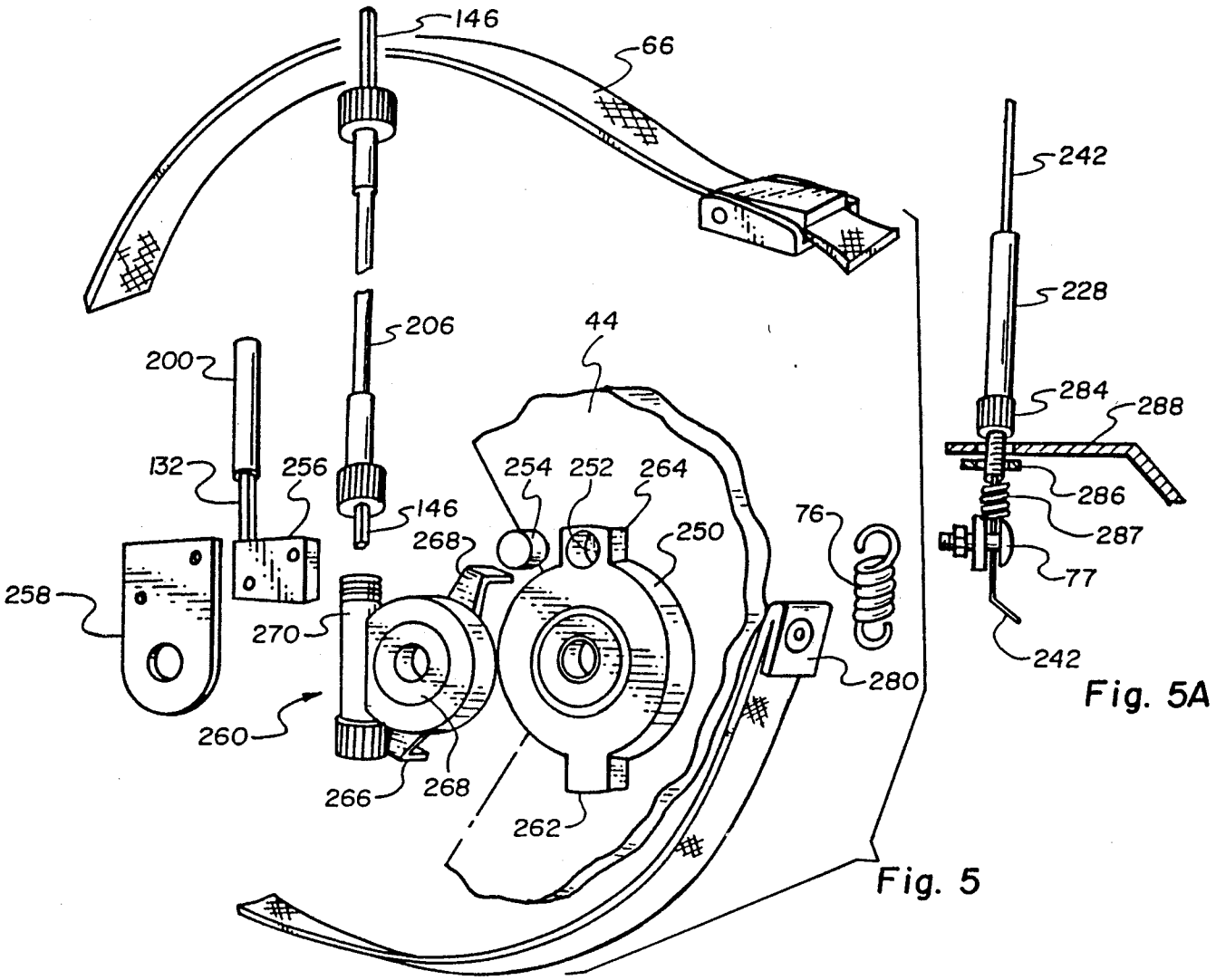
FIG. 5 is a partial exploded depiction of portions of an exercise machine and controller of the instant invention.

Referring now to FIG. 5, a general depiction in cutaway of the stationary cycle 10 is shown with a hub 250 having a hole 252 drilled in one finger 264 thereof to receive a magnet 254. Upon rotation of the flywheel 44, the magnet 254 passes a typical magnetic reed switch pickup 256 which is held onto the hub structure by bracket 258. The reed switch pickup 256 in turn sends electrical signals via conductor 132 within cable 200 for interconnection to the electronic console 130 (FIGS. 2 and 4) to supply a speed or RPM signal thereto.

In FIG. 5, a typical speedometer drive structure 260 is illustrated interconnected over the hub 250 to be driven by the fingers 262 and 264. That is, the arms 266 and 268 of the speedometer drive are positioned to be driven by the fingers 264 and 262 to in turn cause an internal gear 268 to drive a worm within the housing 270 and in turn cause the internal cable 146 to rotate within the sheath 206 for transmission of rotational movement to in turn drive the worm 144 (FIG. 4).

The strap 66 of the exercise cycle 10 of FIG. 1 extends around flywheel 44 and has a grommet arrangement 77 at one end thereof. It is further connected to a nut-and-bolt arrangement 77 to spring 76. Movement of the internal cable 242 of the sheathed cable 228 axially causes the spring 76 to tension the strap 66 to in turn loosen or tighten about the flywheel 44 and in turn decrease or increase the friction and the resulting resistance respectively. The end 284 of the sheathed cable 228 is securely held by a nut 286 on bracket 288 which is further secured to the upright or forward frame member 12 or any other appropriate frame structure available for the exercise machine involved. A compression spring 287 is positioned between the nut-and-bolt arrangement 77 and the nut 286 to urge the nut and bolt arrangement 77 away and in turn tension the cam follower 114 against a cam surface such as surface 116.

Figure 6:
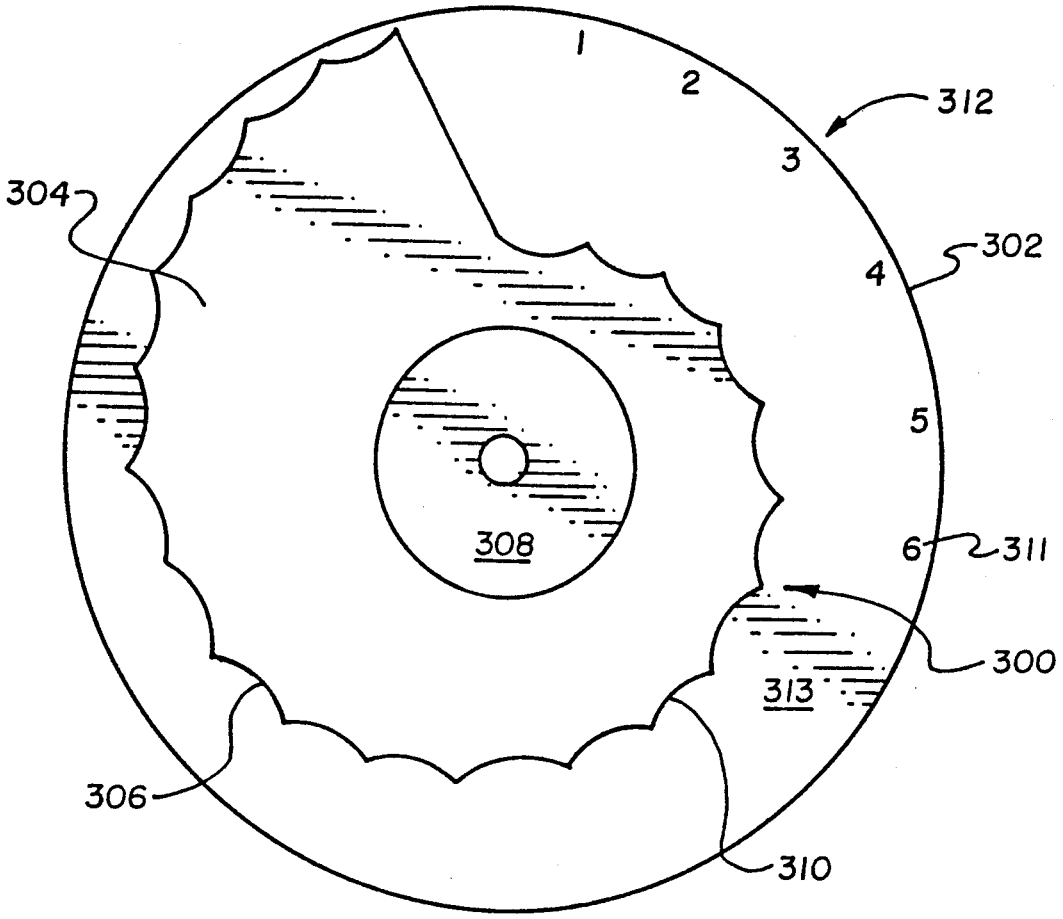
FIGS. 6 and 7 illustrate cam means of the controller of the instant invention.

FIG. 6 shows an alternate disk-like structure 300 having a cover 302 and a cam 304 with a cam surface 306. The disk-like structure 300 also has a centrally positioned gear 308 which is here shown to not have any teeth. The disk-like structure 300 of FIG. 6 may be positioned with gear 308 within the recess 104 and the cam 304 within the recess 94 (FIG. 2). The gear 308 has no teeth, and is sized to not contact gear 106. As a result, movement of the flywheel 44 and in turn movement of the gear 106 will not cause the gear 308 to operate and in turn cause the disk to rotate 304. Instead, disk 304 is manually positioned by the user rotating the dome 302 to a desired configuration in which the cam follower 114 rests on any one of several indentations 310. The user may manually select an indentation to obtain a desired resistance and leave that selection in place throughout the duration of the desired exercise or in the alternative vary the resistance at different times during the course of an exercise when the desired exercise program is not available in another disk. Various numberings 311 or other indications may be placed on the top 312 of the dome 302 so the user may better be able to select a desired resistance on a repetitive basis. The numberings 311 normally are placed on top 312 of the dome 302 but are here shown on the bottom or inside 313 of the dome 302 only for illustration.

Figure 7:
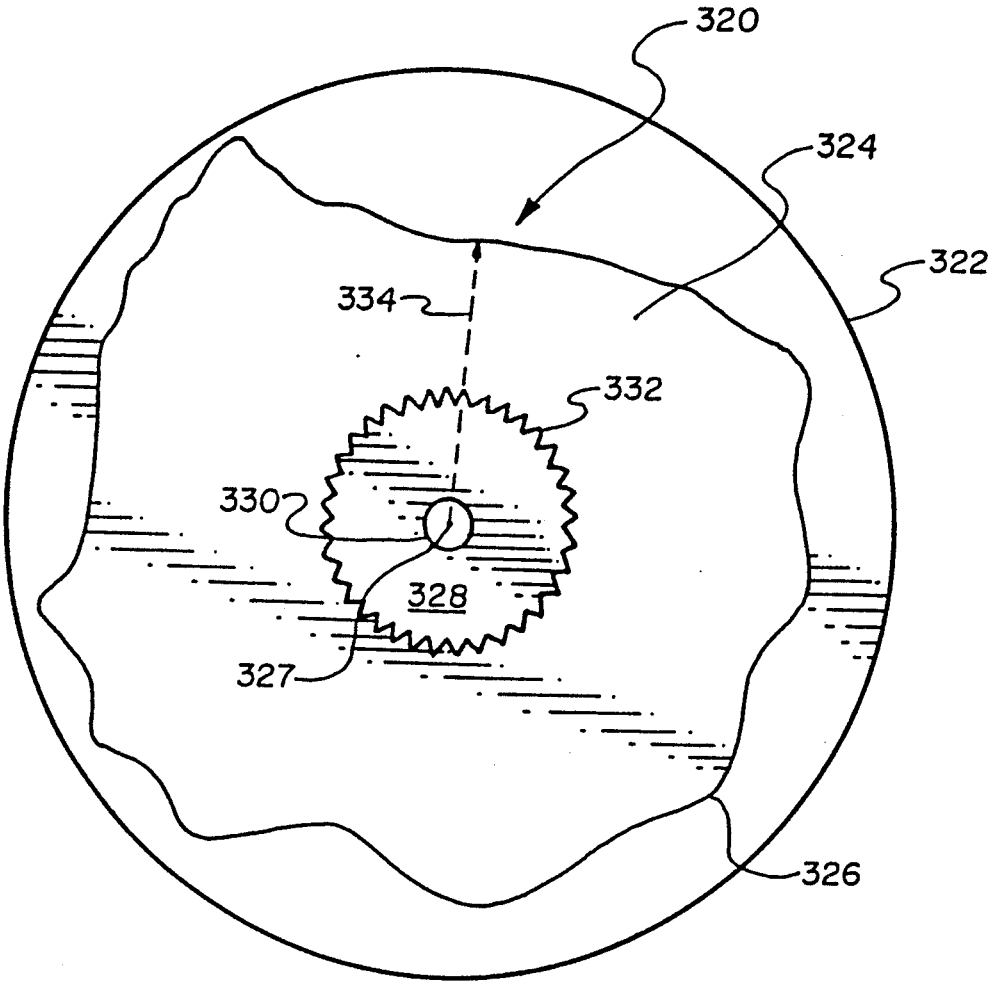

FIG. 7 shows a more typical disk-like 320 structure having a dome or cover 322 with a cam 324. Centrally positioned is spur gear 328 having an aperture 30 which is selected to register with the post 108 so that the gear 328 fits within the recess 104 (FIG. 2). Upon positioning within the recess 104, the teeth 332 of the gear 328 drivingly mesh with the gear 106 in order to cause the disk-like 320 structure to rotate. As the disk-like 320 structure rotates, the cam surface 328 is followed by the cam follower 114 as it moves within the slot 118 to in turn cause the cable 242 to move and in turn cause the strap 66 to tighten and loosen. More specifically, as the distance 334 of the cam surface 326 from the axis 327 changes or becomes larger, the cable 242 (FIG. 4) moves inwardly 243 to in turn cause the strap 66 to tighten about the flywheel 44 and increase the resistance.

Figure 8:
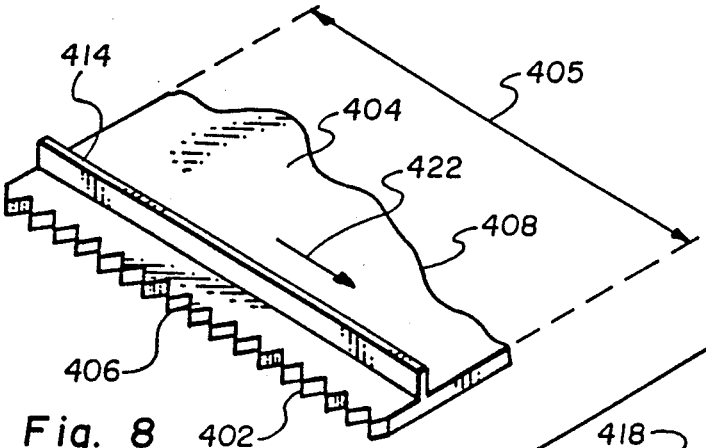
FIG. 8 shows an alternate configuration of the conversion means and the cam means of the controller of the instant invention.
Figure 8A:
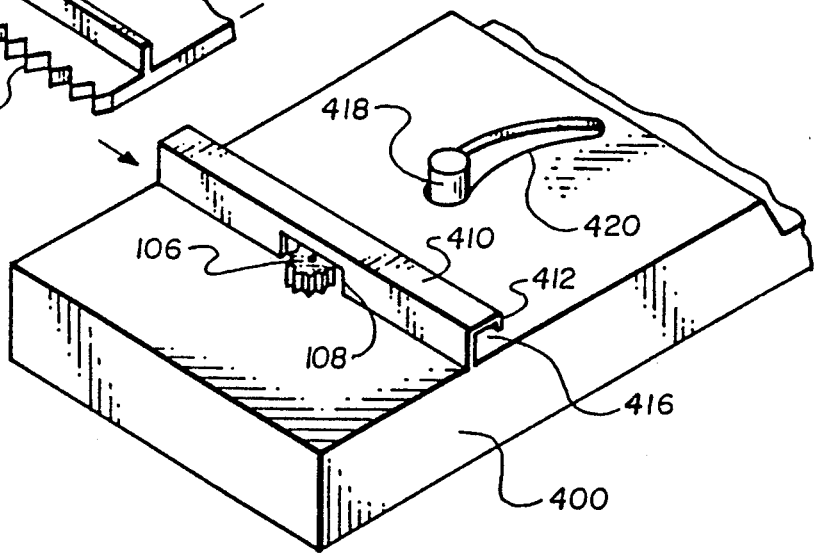

Referring now to FIG. 8, an alternate arrangement for the conversion means is illustrated. More particularly, a chassis 400 is shown to contain a substantially similar reduction gear arrangement as that illustrated in FIG. 3. However, in FIG. 8, the driver 106 is positioned in an aperture 108 to drivingly interconnect with a rack or teeth 402 of the cam means which as here illustrated is comprised of a substrate 404. The rack or teeth 402 is formed along one edge 406. The cam surface 408 is opposite the rack or toothed edge 406.

A guide 410 with a lip 412 may be secured to the chassis 400 with a corresponding guide 414 secured to the substrate 404. In operation, the guide 414 is positioned to be within the lip 412 to retain the teeth 402 in driving or meshed interconnection with the gear 106. In operation, the substrate 404 is inserted into the slot 416 so the guide 414 is within the slot and held by the lip 412. The cam follower 418 rides within the slot 420 similar to the cam follower 114 of FIG. 2. The cam follower 418 rides upon the cam surface 408 as the gear 106 drives the substrate 404 from left to right 422. As the cam follower 418 rides along the cam surface 408, it pivots a pivot arm similar to the pivot arm 220 of FIG. 4 to in turn cause a cable similar to internal cable 242 to move within its sheath.

Figure 9:
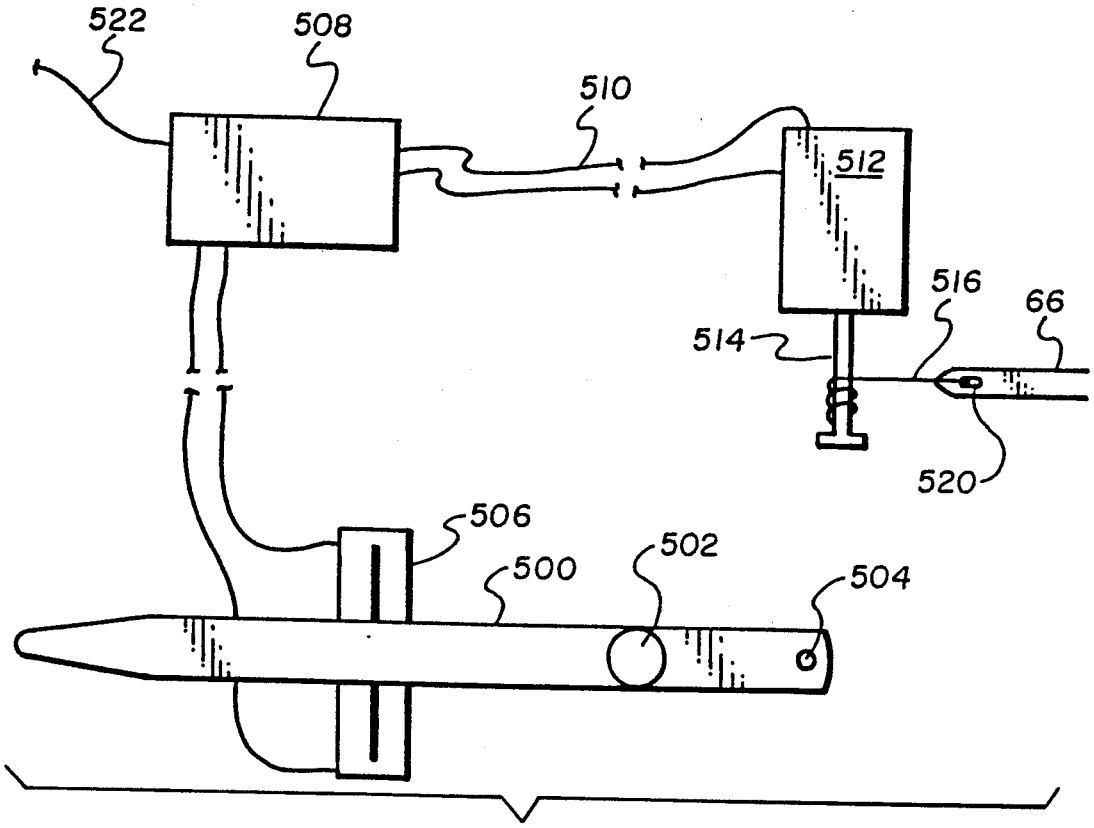
FIG. 9 illustrates an alternate reading means and receiving means of a controller of the instant invention.

Referring to FIG. 9, an alternate pivot arm 500 is shown with a cam follower 502 positioned thereon. Pivot arm 500 rotates about an axle 504 and in turn causes a variable resistor 506 to vary in electrical resistance. An electrical circuit 508 in provided in order apply power to the variable resistor 506 and in turn generate a variable signal reflective of the movement of the pivot arm 500 about its pivot axle 504. The resistor 506 shown is a linear potentiometer. However, other forms of variable resistor may be used including a rotatory potentiometer positioned about the shaft 504. Electrical circuit 508 in turn supplies an appropriate electrical output via conductors 510 to an electrical device 512 which operates a shaft 514 to rotate either in a clockwise or counterclockwise direction to wind or unwind a cable 516 which is connected to the end of the strap 66 through grommet 520. Electrical device 512 may be any suitable electrical device such as a reversible D.C. motor. The electrical circuit 508 may be any conventional circuit devised to receive power from an external source via conductor 522 and supply variable electrical signals in accordance with the movement of the pivot arm 500 as sensed by the variable resistor 506. Other devices may be equally suitable including solenoids, servo motors, servo transmitters and receivers, or the like.

Figure 10:
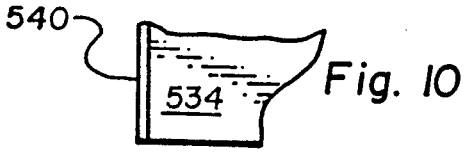
FIG. 10 is a depiction of an alternate driver and engaging means of a cam for use in the instant invention.
Figure 10A:
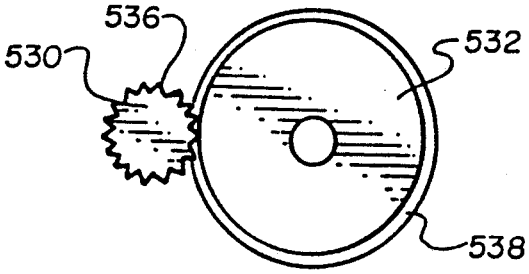

Referring to FIG. 10, an alternate arrangement of the driver and cam means is shown. Specifically, gear 530 is shown driving the engaging means or gear 532 to which a cam is secured (not shown). Alternately, a substrate 534 is aligned for driving engagement with gear 530. The gear 530 is shown not with gear teeth but with serrations 536. The gear 532 is shown with an engageable portion 538 which may be any relatively soft material such as rubber, silicon, teflon, nylon or the like which readily and fictionally is engageable with the serrations 536. The substrate 534 may also have a similar engageable portion 540. It may be noted that the gear 530 may have a friction surface as well. Similarly, the gear 532 and substrate 534 may have serrated edges.

The relationship between the driver such as gear 530 and the driven such as gear 532 is one in which one drives the other. A gear arrangement has been illustrated and discussed with respect to FIGS. 2–4 and 8. Alternate arrangements may be suitable such as those discussed with respect to FIG. 10 so long as the driving relationship is effected.

It may also be noted that the cam surface such as surface 116 is mechanically read by the cam follower 116. Other arrangements may be available to read the changes or variations of the cam surface and supply signals to change or vary the resistance.

Figure 11:
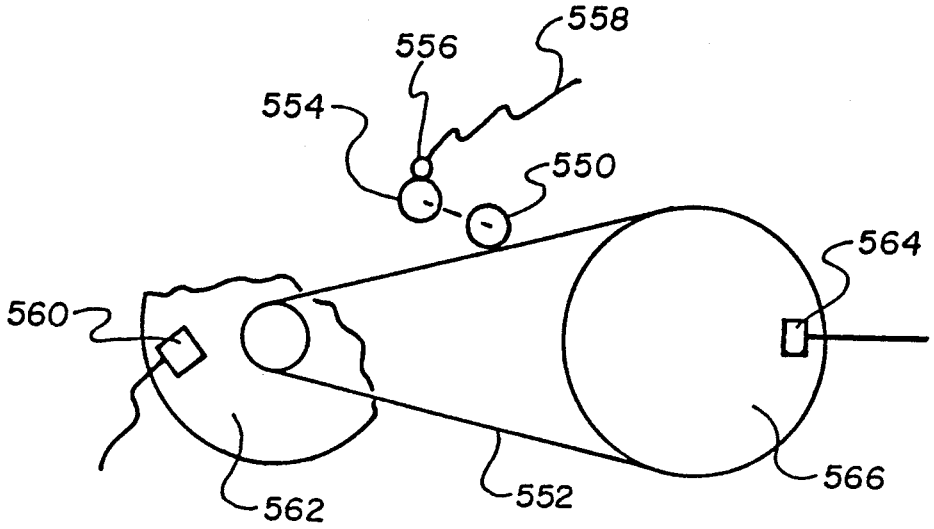
FIG. 11 is a simplified depiction of a drive structure of an exercise cycle with sensing means.

The speedometer drive structure 260 of FIG. 5 with its cable 146 together constitute one form of sensing means to sense movement of operable structure of the exercise machine and to supply movement signals reflective of the movement as rotation of the cable 146. The movement may also be sensed by an idler gear 550 (FIG. 11) connected or positioned by structure not shown to be driven by the chain 552 of an exercise cycle or other chain driven exercise machine. The idler gear 550 is a sprocket which drive a helical gear 554 and in turn a worm 556. The worm drives a cable shaft 558 to in turn drives a worm in a reduction assembly such as worm 144.

Alternately, a rubber wheel 560 may be placed along a surface of a flywheel such as flywheel 562 to be rotated thereby to drive a cable. A rubber wheel 564 may also be placed by the drive sprocket 566.

It should also be understood that the speed or movement signal may be the movement of a treadmill tread and the resistance signal that is necessary to vary the incline of the treadmill or adjust the speed of the tread, or both.

It may be understood that the sensing means hereinbefore described functions to drive or power the conversion means to drive the cam means. Thus, in a simplified system, it may simply be desired to vary the resistance means over time independent of actual performance. In such circumstances, a power supply source such as a windup spring similar to a windup spring for a clock or child's toy may act as a simulated sensing means to power or drive the worm gear 152 and in turn the controller of the invention.

In operation, it can be seen that an appropriate cam means may be positioned to be driven by a driver of a conversion means which converts a movement signal to proportionally operate the driver. The movement sensed by sensing means such as the speedometer drive 260 of FIG. 5 is thus converted into the mechanical driving force to drive the cam means which may be either a disk-like structure such as that illustrated in FIGS. 7 and 2, or a cam-like substrate such as that illustrated in FIG. 8. In either configuration, the cam surface is selected to vary with respect to either the axis of rotation of the driver or the axis of rotation of the disk-like structure to reflect a proportional change to be made in the resistance of the resistance means of an exercise machine such as the exercise cycle 10 illustrated in FIG. 1. Thus the resistance can be made to vary and produce a preselected exercise program which has been devised by causing the cam surface to be prepared in accordance with selected desires of the user or as suggested to effect a desired therapeutic benefit to the user.

As noted, the reading means which is here includes the cam follower translates the variations of the cam surface into resistance signals which are in turn transmitted to and received by the receiving means which are connected to the resistance means of the exercise machine. The receiving means operates the resistance means to vary the resistance in accordance with the signals received from the reading means. As discussed with respect to the exercise cycle 10 of FIG. 1, the strap 66 is either loosened or tightened to decrease or increase the friction and in turn the resistance experienced by the user when pedaling and in turn causing the flywheel 44 to rotate. Thus the user may experience different degrees of difficulty throughout the course of a selected exercise program.

It may be noted that the disk-like structure which is suitable for use may be sized to be either larger or smaller and in turn control the amount of time necessary to complete one revolution and in turn the length of a particular exercise program. Similarly, the overall width 405 of a linear-type cam such as the cam 404 of FIG. 8 will control the overall length of a particular desired exercise program. It may be noted specifically with respect to the cam 404 of FIG. 8, that the user has the opportunity to visually observe progress and the degree of difficulty completed and to be confronted as the structure 404 moves past the driving pinion 106. More particularly, the user will be able to observe the position of the cam follower 418 along the cam surface 408 during the course of the exercise program and thus have obtained the additional benefit of being able to observe personal progress.

As noted hereinbefore, other types of exercise machines other than an exercise cycle may be suitably controlled by a controller of the type hereinbefore illustrated and described. For example, some rowing-type exercisers have a flywheel which is operated by pulling on a cable connected to a gear to in turn cause a flywheel to rotate. Other types of machines may exist and may later be devised that would similarly be suitable for operation with the controller of the type hereinbefore illustrated and disclosed.

It is to be understood that the embodiments of the invention herein described are merely illustrative of the application of the principles of the invention. Reference herein to the details of the illustrated embodiments is not intended to limit the scope of the claims which themselves recite those features regarded as essential to the invention.

We claim:

1. A controller for use with an exercise machine having resistance means for variably resisting the movement of interconnected operable structure, said controller comprising:

sensing means positioned proximate operable structure of an exercise machine to sense the movement of said operable structure and to supply movement signals reflective of said movement;

conversion means secured to said exercise machine and connected to said sensing means to receive said movement signals, said conversion means having a driver and being configured to move said driver in relation to said movement signals;

cam means positioned proximate said driver for movement thereby, said cam means having a cam surface with variations preselected by the user reflective of the desired resistance of the resistance means of said exercise machine;

reading means positioned proximate said cam surface to generate signals reflective of said variations and to supply resistance signals reflective of said variations; and receiving means connected to said reading means to receive said resistance signals and to said resistance means to operate said resistance means to variably resist movement of said operable structure in accordance with said resistance signals.

2. The controller of claim 1 wherein said conversion means moves said driver proportional to said movement signals.

3. The controller of claim 1 wherein said conversion means is a reduction gear assembly interconnected to be driven by said movement signals and to operate said driver.

4. The controller of claim 3 wherein said cam means is a substrate having engaging means configured to be driven by said driver and wherein said substrate has an edge as said cam surface.

5. The controller of claim 4 wherein said driver is a driven gear of said reduction gear and wherein said engaging means is drivingly associated with said driven gear.

6. The controller of claim 5 wherein said cam means is a disk-like structure with a central axis and is rotatable thereabout, said cam surface being the perimeter of the disk-like structure.

7. The controller of claim 4 wherein said engaging means is substantially straight and wherein said cam surface is opposite said engaging means.

8. The controller of claim 4 wherein said driver is a wheel-like device and said engaging means is a contact surface in direct contact therewith.

9. The controller of claim 8 wherein said driver is a serrated edge and said contact surface has a rubber-like construction to frictionally engage said serrated edge.

10. The controller of claim 1 wherein said reading means includes a cam follower and a pivotable lever secured to the cam follower to pivot as the cam follower moves along said cam surface, said pivotable lever having transmission means connected thereto to transmit said resistance signals in relation to movement of said cam follower.

11. The controller of claim 10 wherein said transmission means is a cable secured to said pivotable lever to move axially upon movement of said pivotable lever.

12. The controller of claim 10 wherein said transmission means is a variable electrical resistance interconnected to a source of power to supply variable electrical signals as said resistance signal.

13. The controller of claim 12 wherein said receiving means includes an electrical device connected to receive said variable electrical signals and to operate said resistance means in accordance with said variable electrical signals.

14. The controller of claim 10 wherein said pivotable lever has a handle portion for operation by the user.

15. The controller of claim 1 wherein said operable structure rotates and wherein said sensing means is a speedometer pickup positioned to sense the rotation of said operable structure and a speedometer cable connected to said speedometer pickup to transmit said movement signals.

16. The controller of claim 15 wherein said speedometer cable has a worm gear interconnected to drive said reduction gear assembly.

17. A controller for use with a stationary exercise cycle having a rotating wheel and resistance means interconnected to resist movement of said wheel, said controller comprising:

sensing means positioned proximate the rotating wheel of a stationary exercise cycle to sense the rotation thereof and to supply rotation signals reflective of said rotation;

conversion means secured to said stationary exercise cycle and connected to said sensing means to receive said rotation signals, said conversion means having a driver and being configured to move said driver in relation to said rotation signals;

cam means positioned proximate said driver for movement thereby, said cam means having a cam surface with variations reflective of the desired resistance of the resistance means of the stationary exercise cycle;

reading means positioned proximate said cam surface to generate signals reflective of said variations and to supply resistance signals reflective of said variations; and receiving means connected to said resistance means and to said reading means to receive said resistance signals to operate said resistance means to variably resist movement of said wheel.

18. The controller of claim 17 wherein said sensing means is a speedometer pickup interconnected proximate said wheel with a cable extending to said conversion means to transmit said rotation signals.

19. The controller of claim 18 wherein said conversion means is a reduction gear assembly interconnected to be driven by said rotation signals and to operate said driver.

20. The controller of claim 19 wherein said reading means is a cam follower attached to and along the length of a pivotable lever, said cam follower being positioned to contact said cam surface, and cause said lever to pivot, said pivotable lever having transmission means associated therewith to transmit said resistance signals.

21. The controller of claim 20 wherein said transmission means is a cable which is connected to said pivotable lever to move axially as said resistance signals.

22. The controller of claim 21 wherein said receiving means is a structure secured to said stationary exercise cycle and to said resistance means and connected to said transmission means to receive said resistance signals and to operate said resistance means in accordance therewith.

23. The controller of claim 22 wherein said resistance means is a strap positioned about said wheel and wherein said strap is tightened and loosened upon outward and inward axial movement respectively of said cable.

24. The controller of claim 22 wherein said resistance means is a calliper brake positioned about said wheel and connected to said cable.

25. The controller of claim 20 wherein said transmission means is a variable electrical resistance to supply a variable electrical signal as said resistance signal, and wherein said receiving means is an electrically operable device connected to receive said resistance signal and connected to said resistance means to vary the resistance thereof in accordance with said resistance signal.

26. The controller of claim 25 wherein said electrical device is a reversible DC motor with an output shaft connected to operate said resistance means.

27. The controller of claim 19 wherein said cam means is a substrate having a central axis and engaging means positionable proximate said driver to rotate about said central axis.

28. The controller of claim 27 wherein said cam surface has an edge which is the perimeter of said substrate.

29. The controller of claim 19 wherein said cam means has one edge configured to drivingly interconnect with said driver and another edge as said cam surface.

30. The controller of claim 29 wherein said one edge is substantially straight, wherein said conversion means and said cam means have interlocking structure to slidably retain said one edge drivingly interconnected to said driver, and wherein said cam surface is opposite the one edge.

31. In combination:

an exercise machine having a rotatable wheel operable by a user in the performance of exercises and a resistance means to vary the resistance of said rotatable wheel;

a controller comprising:

sensing means positioned to sense the rotation of said rotatable wheel and to supply rotation signals proportional to the rotation of said rotatable wheel, conversion means secured to said exercise machine and connected to said sensing means to receive said rotation signals, said conversion means having a driver and being configured to operate said driver in proportion to said rotation signals, cam means positioned proximate said driver for movement thereby, said cam means having a cam surface with variations reflective of the desired resistance of the resistance means of the stationary exercise cycle;

reading means positioned proximate said cam surface to generate signals reflective of said variations and to supply resistance signals reflective of said variations; and receiving means connected to said resistance means and to said reading means to receive said resistance signals to operate said resistance means to variably resist movement of said wheel.

32. A controller for use with an exercise machine having resistance means for variably resisting the movement of interconnected operable structure, said controller comprising:

power supply means positioned with respect to an exercise machine to supply driving signals;

conversion means secured to said exercise machine and connected to said power supply means to receive said driving signals, said conversion means having a driver and being configured to move said driver in relation to said driving signals;

cam means positioned proximate said driver for movement thereby, said cam means having a cam surface with variations preselected by the user reflective of the desired resistance of the resistance means of said exercise machine;

reading means positioned proximate said cam surface to generate signals reflective of said variations and to supply resistance signals reflective of said variations; and receiving means connected to said reading means to receive said resistance signals and to said resistance means to operate said resistance means to variably resist movement of said operable structure in accordance with said resistance signals.

* * * * *